US007661471B2

(12) United States Patent
Murray et al.

(10) Patent No.: US 7,661,471 B2
(45) Date of Patent: Feb. 16, 2010

(54) SELF ENERGIZED BACKUP SYSTEM FOR PACKER SEALING ELEMENTS

(75) Inventors: Douglas J. Murray, Humble, TX (US); Vel Berzin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 252 days.

(21) Appl. No.: 11/292,013

(22) Filed: Dec. 1, 2005

(65) Prior Publication Data

US 2007/0125532 A1 Jun. 7, 2007

(51) Int. Cl.
*E21B 33/12* (2006.01)

(52) U.S. Cl. ..... 166/179; 166/195; 166/187

(58) Field of Classification Search ..... 166/387, 166/179, 195, 187
See application file for complete search history.

(56) References Cited

U.S. PATENT DOCUMENTS

| | | | | | |
|---|---|---|---|---|---|
| 2,981,333 | A * | 4/1961 | Montgomery et al. | ..... | 166/276 |
| 3,918,523 | A | 11/1975 | Stuber | | |
| 4,137,970 | A | 2/1979 | Laflin et al. | | |
| 4,424,865 | A * | 1/1984 | Payton, Jr. | ..... | 166/302 |
| 4,554,973 | A * | 11/1985 | Shonrock et al. | ..... | 166/192 |
| 4,612,985 | A | 9/1986 | Rubbo et al. | | |
| 4,614,346 | A * | 9/1986 | Ito | ..... | 277/334 |
| RE32,831 | E * | 1/1989 | Shonrock et al. | ..... | 166/135 |
| 4,862,967 | A * | 9/1989 | Harris | ..... | 166/387 |
| 4,913,232 | A * | 4/1990 | Cheymol et al. | ..... | 166/285 |
| 4,919,989 | A | 4/1990 | Colangelo | | |
| 4,936,386 | A | 6/1990 | Colangelo | | |
| 5,027,894 | A * | 7/1991 | Coone et al. | ..... | 166/122 |
| 5,048,605 | A | 9/1991 | Toon et al. | | |
| 5,195,583 | A * | 3/1993 | Toon et al. | ..... | 166/187 |
| 5,311,938 | A * | 5/1994 | Hendrickson et al. | ..... | 166/134 |
| 6,009,951 | A * | 1/2000 | Coronado et al. | ..... | 166/387 |
| 6,073,692 | A | 6/2000 | Wood et al. | | |
| 6,581,682 | B1 * | 6/2003 | Parent et al. | ..... | 166/180 |
| 6,834,725 | B2 | 12/2004 | Whanger et al. | | |
| 6,843,315 | B2 * | 1/2005 | Coronado et al. | ..... | 166/196 |
| 6,848,505 | B2 | 2/2005 | Richard et al. | | |
| 6,854,522 | B2 * | 2/2005 | Brezinski et al. | ..... | 166/387 |
| 7,216,706 | B2 * | 5/2007 | Echols et al. | ..... | 166/285 |

(Continued)

FOREIGN PATENT DOCUMENTS

JP 04-363499 12/1992

(Continued)

*Primary Examiner*—David J Bagnell
*Assistant Examiner*—David Andrews
(74) *Attorney, Agent, or Firm*—Steve Rosenblatt

(57) ABSTRACT

Preformed ribs are held closely to the swelling element and then are allowed to assume an expanded position to capture the ends of the swelling element. Many variations are possible one of which is retaining the ribs in a run in position with a band that releases by interaction with well fluid. In another embodiment the ribs are of a shape memory material and go to the enlarged state after a time and exposure to well fluids. The swelling action of the element could urge the ribs to the expanded position. Alternatively, a retractable sleeve can be actuated after a delay using a piston and a sealed compartment where a material must dissolve or otherwise go away before the piston can stroke to remove a retainer from ribs that can then move out.

20 Claims, 1 Drawing Sheet

U.S. PATENT DOCUMENTS

| | | | | |
|---|---|---|---|---|
| 2002/0070503 | A1* | 6/2002 | Zimmerman et al. | 277/337 |
| 2002/0195244 | A1* | 12/2002 | Coronado et al. | 166/196 |
| 2004/0020662 | A1 | 2/2004 | Freyer | |
| 2004/0055760 | A1 | 3/2004 | Nguyen | |
| 2004/0118572 | A1 | 6/2004 | Whanger et al. | |
| 2004/0194971 | A1 | 10/2004 | Thomson | |
| 2004/0261990 | A1 | 12/2004 | Bosma et al. | |
| 2005/0067170 | A1 | 3/2005 | Richard | |
| 2005/0092363 | A1 | 5/2005 | Richard et al. | |
| 2005/0110217 | A1* | 5/2005 | Wood et al. | 277/333 |
| 2005/0171248 | A1 | 8/2005 | Li et al. | |
| 2006/0219400 | A1* | 10/2006 | Xu et al. | 166/187 |
| 2006/0243457 | A1* | 11/2006 | Kossa et al. | 166/387 |
| 2006/0260820 | A1* | 11/2006 | Whitsitt et al. | 166/387 |
| 2006/0272806 | A1* | 12/2006 | Wilkie et al. | 166/192 |

FOREIGN PATENT DOCUMENTS

| | | |
|---|---|---|
| JP | 09-151686 | 6/1997 |
| JP | 2000-064764 | 2/2000 |
| WO | WO 2004/018836 A1 | 3/2004 |

* cited by examiner

SELF ENERGIZED BACKUP SYSTEM FOR PACKER SEALING ELEMENTS

FIELD OF THE INVENTION

The field of this invention is packers and plugs for downhole use and more particularly elements that swell to seal with a backup feature to control extrusion.

BACKGROUND OF THE INVENTION

Packers and plugs are used downhole to isolate zones and to seal off part of or entire wells. There are many styles of packers on the market. Some are inflatable and others are mechanically set with a setting tool that creates relative movement to compress a sealing element into contact with a surrounding tubular. Generally, the length of such elements is reduced as the diameter is increased. Pressure is continued from the setting tool so as to build in a pressure into the sealing element when it is in contact with the surrounding tubular.

More recently, packers have been used that employ elements that respond to the surrounding well fluids and swell to form a seal. Many different materials have been disclosed as capable of having this feature and some designs have gone further to prevent swelling until the packer is close to the position where it will be set. These designs were still limited to the amount of swelling from the sealing element as far as the developed contact pressure against the surrounding tubular or wellbore. The amount of contact pressure is a factor in the ability to control the level of differential pressure. In some designs there were also issues of extrusion of the sealing element in a longitudinal direction as it swelled radially but no solutions were offered. A fairly comprehensive summation of the swelling packer art appears below:

I. References Showing a Removable Cover Over a Swelling Sleeve

1) Application US 2004/0055760 A1

FIG. 2*a* shows a wrapping 110 over a swelling material 102. Paragraph 20 reveals the material 110 can be removed mechanically by cutting or chemically by dissolving or by using heat, time or stress or other ways known in the art. Barrier 110 is described in paragraph 21 as an isolation material until activation of the underlying material is desired. Mechanical expansion of the underlying pipe is also contemplated in a variety of techniques described in paragraph 24.

2) Application US 2004/0194971 A1

This reference discusses in paragraph 49 the use of water or alkali soluble polymeric covering so that the actuating agent can contact the elastomeric material lying below for the purpose of delaying swelling. One way to accomplish the delay is to require injection into the well of the material that will remove the covering. The delay in swelling gives time to position the tubular where needed before it is expanded. Multiple bands of swelling material are illustrated with the uppermost and lowermost acting as extrusion barriers.

3) Application US 2004/0118572 A1

In paragraph 37 of this reference it states that the protective layer 145 avoids premature swelling before the downhole destination is reached. The cover does not swell substantially when contacted by the activating agent but it is strong enough to resist tears or damage on delivery to the downhole location. When the downhole location is reached, pipe expansion breaks the covering 145 to expose swelling elastomers 140 to the activating agent. The protective layer can be Mylar or plastic.

4) U.S. Pat. No. 4,862,967

Here the packing element is an elastomer that is wrapped with an imperforate cover. The coating retards swelling until the packing element is actuated at which point the cover is "disrupted" and swelling of the underlying seal can begin in earnest, as reported in Column 7.

5) U.S. Pat. No. 6,854,522

This patent has many embodiments. The one in FIG. 26 is foam that is retained for run in and when the proper depth is reached expansion of the tubular breaks the retainer 272 to allow the foam to swell to its original dimension.

6) Application US 2004/0020662 A1

A permeable outer layer 10 covers the swelling layer 12 and has a higher resistance to swelling than the core swelling layer 12. Specific material choices are given in paragraphs 17 and 19. What happens to the cover 10 during swelling is not made clear but it presumably tears and fragments of it remain in the vicinity of the swelling seal.

7) U.S. Pat. No. 3,918,523

The swelling element is covered in treated burlap to delay swelling until the desired wellbore location is reached. The coating then dissolves of the burlap allowing fluid to go through the burlap to get to the swelling element 24 which expands and bursts the cover 20, as reported in the top of Column 8)

8) U.S. Pat. No. 4,612,985

A seal stack to be inserted in a seal bore of a downhole tool is covered by a sleeve shearably mounted to a mandrel. The sleeve is stopped ahead of the seal bore as the seal first become unconstrained just as they are advanced into the seal bore.

II. References Showing a Swelling Material under an Impervious Sleeve

1) Application US 2005/0110217

An inflatable packer is filled with material that swells when a swelling agent is introduced to it.

2) U.S. Pat. No. 6,073,692

A packer has a fluted mandrel and is covered by a sealing element. Hardening ingredients are kept apart from each other for run in. Thereafter, the mandrel is expanded to a circular cross section and the ingredients below the outer sleeve mix and harden. Swelling does not necessarily result.

3) U.S. Pat. No. 6,834,725

FIG. 3*b* shows a swelling component 230 under a sealing element 220 so that upon tubular expansion with swage 175 the plugs 210 are knocked off allowing activating fluid to reach the swelling material 230 under the cover of the sealing material 220.

4) U.S. Pat. No. 5,048,605

A water expandable material is wrapped in overlapping Kevlar sheets. Expansion from below partially unravels the Kevlar until it contacts the borehole wall.

5) U.S. Pat. No. 5,195,583

Clay is covered in rubber and a passage leading from the annular space allows well fluid behind the rubber to let the clay swell under the rubber.

6) Japan Application 07-334115

Water is stored adjacent a swelling material and is allowed to intermingle with the swelling material under a sheath 16.

III. References Which Show an Exposed Sealing Element that Swells on Insertion

1) U.S. Pat. No. 6,848,505

An exposed rubber sleeve swells when introduced downhole. The tubing or casing can also be expanded with a swage.

2) PCT Application WO 2004/018836 A1

A porous sleeve over a perforated pipe swells when introduced to well fluids. The base pipe is expanded downhole.

3) U.S. Pat. No. 4,137,970

A swelling material 16 around a pipe is introduced into the wellbore and swells to seal the wellbore.

4) US Application US 2004/0261990

Alternating exposed rings that respond to water or well fluids are provided for zone isolation regardless of whether the well is on production or is producing water.

5) Japan Application 03-166,459

A sandwich of slower swelling rings surrounds a faster swelling ring. The slower swelling ring swells in hours while the surrounding faster swelling rings do so in minutes.

6) Japan Application 10-235,996

Sequential swelling from rings below to rings above trapping water in between appears to be what happens from a hard to read literal English translation from Japanese.

7) U.S. Pat. Nos. 4,919,989 and 4,936,386

Bentonite clay rings are dropped downhole and swell to seal the annular space, in these two related patents.

8) US Application US 2005/009263 A1

Base pipe openings are plugged with a material that disintegrates under exposure to well fluids and temperatures and produces a product that removes filter cake from the screen.

9) U.S. Pat. No. 6,854,522

FIG. 10 of this patent has two materials that are allowed to mix because of tubular expansion between sealing elements that contain the combined chemicals until they set up.

10) US Application US 2005/0067170 A1

Shape memory foam is configured small for a run in dimension and then run in and allowed to assume its former shape using a temperature stimulus.

IV. Reference that Shows Power Assist Actuated Downhole to Set a Seal

1) U.S. Pat. No. 6,854,522

This patent employs downhole tubular expansion to release potential energy that sets a sleeve or inflates a bladder. It also combines setting a seal in part with tubular expansion and in part by rotation or by bringing slidably mounted elements toward each other. FIGS. 3, 4, 17-19, 21-25, 27 and 36-37 are illustrative of these general concepts.

The various concepts in U.S. Pat. No. 6,854,522 depend on tubular expansion to release a stored force which then sets a material to swelling. As noted in the FIG. 10 embodiment there are end seals that are driven into sealing mode by tubular expansion and keep the swelling material between them as a seal is formed triggered by the initial expansion of the tubular.

What has been lacking in the prior art is an effective extrusion barrier to address the issue when using a swelling sealing element. Those skilled in the art will appreciate the various solutions offered by the present invention to this issue from a review of the description of the preferred embodiments, the drawings and the claims that all appear below.

SUMMARY OF THE INVENTION

Preformed ribs are held closely to the swelling element and then are allowed to assume an expanded position to capture the ends of the swelling element. Many variations are possible one of which is retaining the ribs in a run in position with a band that releases by interaction with well fluid. In another embodiment the ribs are of a shape memory material and go to the enlarged state after a time and exposure to well fluids. The swelling action of the element could urge the ribs to the expanded position. Alternatively, a retractable sleeve can be actuated after a delay using a piston and a sealed compartment where a material must dissolve or otherwise go away before the piston can stroke to remove a retainer from ribs that can then move out.

DETAILED DESCRIPTION OF THE PREFERRED EMBODIMENT

Figure 1:
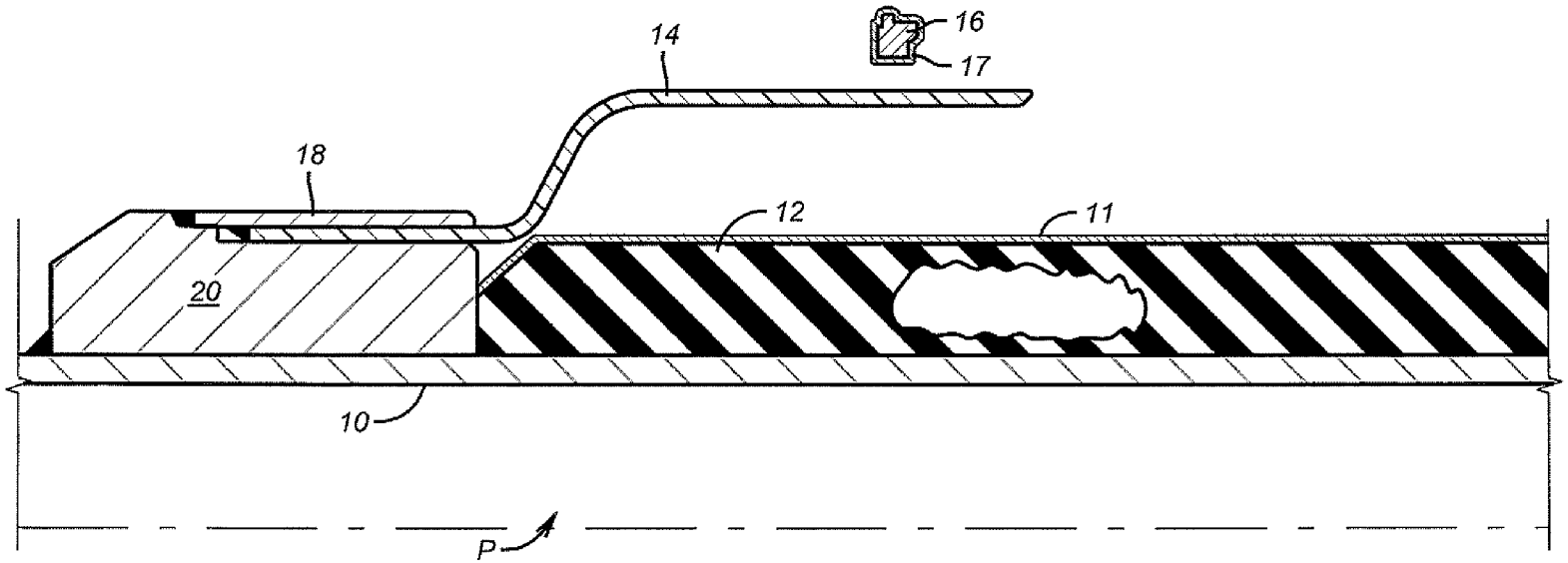
FIG. 1 is a section view of a rib type retainer having already moved to the operating position before the sealing element has swelled to meet it.

FIG. 1 is schematic and will be used to illustrate a number of variations of the present invention. The packer P has a mandrel 10 with a sealing element 12 surrounding it. Shown in section is a rib 14 that is spaced apart from the sealing element 12. In the preferred embodiment the element 12 swells from exposure to well fluids with the swelling delayed until the packer P is close to its ultimate position in the wellbore. This delay can be accomplished by a cover (not shown) that goes away or dissolves based on a time and temperature exposure to well fluids. The choice of swelling materials for the element 12 as well as a delaying mechanism for initiation or conclusion of the swelling can be made from materials and techniques known in the art and described in detail in the patents and applications discussed above. The ribs 14 can be made from a variety of materials. Some preferred properties of ribs 14 are the ability to store a force so that they can assume the position shown in FIG. 1 even if they are retained or otherwise in a position of having a smaller diameter for run in. For example resilient materials that can be secured to a small diameter but that can assume an expanded diameter to function as extrusion barriers for the element 12 are one option. The ribs 14 can be made of a shape memory material that can be run in having a small diameter and then, after being placed into position, be triggered to its former shape that is a large enough diameter to contact the surrounding tubular to serve as an extrusion barrier for the element 12. The trigger signal for the shape memory material can be an exposure to fluids at a certain temperature for a given time or some other trigger. The ribs 14 can be made of a bistable material that upon getting the trigger signal, such as initial swelling of the element 12 or another locally applied force from a different source that is beneath it, snaps to the larger diameter position and gains rigidity in that position.

Alternatively, the swelling of the seal 12 can snap a retaining ring, shown schematically as 16 to liberate the stored force in the ribs 14 to make them spring out. The ribs may be mounted in a cantilevered format having an end 18 affixed to a mounting block 20 supported by the mandrel 10. Ring 16 may be a sleeve that dissolves in well fluids. In the preferred embodiment the ribs 14 are deployed first before the swelling of the element 12 begins or at least before swelling of the element 12 brings it in contact with the ribs 14. Alternatively, the force generated by swelling of element 12 can be the mechanism for breaking a retainer such as 16. Alternatively, if the ribs are bistable, the swelling of the element 12 against the ribs 14 can trigger the outward movement of the ribs 14 as they assume rigidity in an enlarged diameter configuration.

The ribs 14 can be preferably overlapping or spaced apart, depending on the material selected for the element 12. The ribs enhance the ability of the element to withstand differential pressure as they obtain greater sealing contact in cased or open hole when greater differential pressures are applied.

The retainer band or sleeve 16 can be a combination of a polymer 17 and a metal that both dissolve or go away in series upon exposure to well fluids. The metal gives structural strength to hold the ribs 14 in the run in position while the polymer which is outside the metal acts as a time delay as it dissolves or goes away initially. After the polymer goes away the well fluids will attack the metal until the band or sleeve 16 fails thus allowing the ribs 14 to move out to the anti extrusion position where the element 12 is protected.

Figure 2:
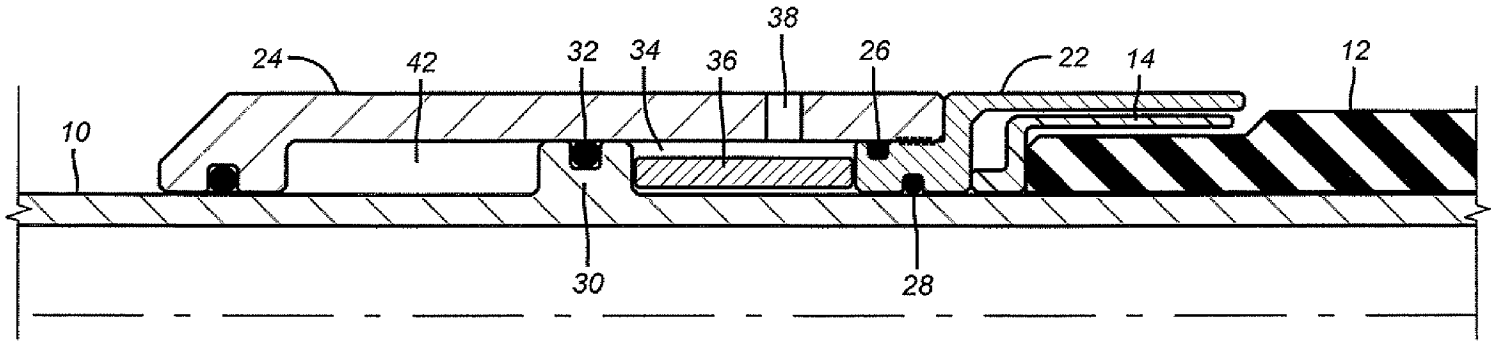
FIG. 2 is a section view of a piston acting on a low pressure chamber that is prevented from stroking and moving the retainer away from the ribs until a blocking material dissolves or goes away.

Another variation is illustrated in FIG. 2. Here the element 12 has the ribs 14 held in for run in by a retainer 22. Those skilled in the art will appreciate that the other end of the element 12 can optionally be a mirror image of FIG. 2. A housing 24 overlaps mandrel 10 and retainer 22. Seals 26 and 28 seal between mandrel 10 and housing 24. Mandrel 10 has a projection 30 with a seal 32 that engages the housing 24. The seals 26, 28 and 30 define a chamber 34 that is accessible to well fluids through a port 38. A material 36 that is initially structurally strong is in chamber 34 and prevents initial movement of housing 24 and retainer 22. Seal 40 and seal 32 define an atmospheric chamber 42 between housing 24 and mandrel 10. Those skilled in the art will realize that seals 26 and 28 are optional.

In operation, the mandrel 10 is lowered to the location in the wellbore where the element 12 is to be set. As previously stated it is advantageous to let the ribs 14 assume their anti-extrusion position before the swelling of element 12 is initiated and certainly before such swelling is completed. In the FIG. 2 design, the ribs 14 are configured to spring out in the surrounding wellbore on retraction of the retainer 22 from the position it is shown in FIG. 2. Retraction of the retainer 22 is initially precluded by the presence of material 36 in a structurally rigid condition in chamber 34. However, delivery of the mandrel 10 downhole allows well fluids to pass through passage 38 to begin to undermine the structural integrity of material 36. This can occur by dissolving material 36 or by other techniques that make it crumble or otherwise lose integrity. Once material 36 is weakened, the available hydrostatic pressure acts on housing 24 at retainer 22 and movement to the left that withdraws the retainer 22 from being over the ribs 14 is resisted only by the low pressure in chamber 42. As a result, the ribs 14 now are freed to move radially to the cased or open hole. The element 12 may have had its swelling delayed by a cover 11 that goes away by interaction with well fluids which then set about to induce swelling in element 12 to complete the seal in the wellbore.

Those skilled in the art will appreciate that the present invention allows for a packer or plug to automatically actuate by being placed in position in the wellbore. When combined with a swelling element the invention provides an anti-extrusion system that itself is automatically triggered, preferably before any swelling but also possibly during swelling. Swelling can be the trigger to release the retainer for the ribs 14. The ribs enhance the ability of the element 12 to resist differential pressures while addressing the concerns regarding element extrusion. The ribs can be resilient so that they are retained for a small run in dimension and then allowed to spring out as the retainer is defeated. The retainer can be attacked by well fluids or removed by an applied physical force or even the onset of swelling of the element 12. The retainer can also be retractable, and one embodiment of such as design is illustrated in FIG. 2. Ideally the ribs are overlapping and assume the annulus straddling position before all the element swelling has occurred or even before any element swelling has occurred. The ribs are preferably cantilevered while overlapping but may also have their unsupported ends loosely connected to help them retain relative positions as they move out radially in cased or open hole.

The invention encompasses sealing elements that don't swell and that are mechanically driven to increase in diameter by longitudinal compression or by mandrel expansion or inflation, for example, and where the anti-extrusion ribs are present and separately actuated from the sealing element or actuated at the same time by the same or a different mechanism.

While the preferred embodiment has been set forth above, those skilled in art will appreciate that the scope of the invention is significantly broader and as outlined in the claims which appear below.

We claim:

1. A packer for cased or open hole borehole use, comprising:

a mandrel;

a sealing element selectively movable to seal against the borehole;

a cantilevered anti-extrusion device mounted adjacent at least one end of said element and radially overlapping said sealing element, said anti-extrusion device selectively initially movable against the borehole by said sealing element, and thereafter, at least in part, said anti-extrusion device is subsequently movable independent of movement of said element toward initial contact with the borehole for support of said sealing element in sealing the borehole.

2. The packer of claim 1, wherein:

said anti-extrusion device comprises a plurality of ribs that form a smaller dimension for run in and grow to a larger dimension against the borehole.

3. The packer of claim 2, wherein:

said ribs are overlapping for run in and when moved against the borehole.

4. A packer for cased or open hole borehole use, comprising:

a mandrel;

a sealing element selectively movable to seal against the borehole;

a cantilevered anti-extrusion device mounted adjacent at least one end of said element and radially overlapping said sealing element, said anti-extrusion device selectively initially movable against the borehole by said sealing element, and thereafter, at least in part, said anti-extrusion device is subsequently movable independent of movement of said element;

said anti-extrusion device comprises a plurality of ribs that form a smaller dimension for run in and grow to a larger dimension against the borehole;

said ribs are radially and directly retained to their small dimension by a retainer that is defeated.

5. The packer of claim 4, wherein:

said retainer is defeated by the surrounding well fluids allowing said ribs to spring into contact with the borehole.

6. The packer of claim 4, wherein:

said retainer is defeated by exposure to surrounding well fluids.

7. The packer of claim 4, wherein:

said retainer is defeated by an applied force.

8. The packer of claim 7, wherein:

said applied force that defeats said retainer originates from said sealing element moving toward the borehole by virtue of one or more of longitudinal compression, mandrel expansion, inflation and swelling from exposure to well fluids.

9. The packer of claim 8, wherein:

said sealing element moves from swelling on exposure to well fluids.

10. The packer of claim 4, wherein:

said sealing element is covered with a removable cover to delay the onset of swelling until after defeat of said retainer.

11. A packer for cased or open hole borehole use, comprising:

a mandrel;

a sealing element selectively movable to seal against the borehole;

an anti-extrusion device mounted adjacent at least one end of said element and selectively movable against the borehole, at least in part, independent of movement of said element;

said anti-extrusion device comprises a plurality of ribs that form a smaller dimension for run in and grow to a larger dimension against the borehole;

said ribs are radially retained to the small dimension by a retainer that selectively overlaps said ribs and that is movable along said mandrel.

12. The packer of claim 11, wherein:

said retainer is connected to a piston that is held immobile for run in by a locking member that is defeated downhole.

13. The packer of claim 12, wherein:

said locking member is defeated before said sealing element engages the borehole.

14. A packer for cased or open hole borehole use, comprising:

a mandrel;

a sealing element selectively movable to seal against the borehole;

an anti-extrusion device mounted adjacent at least one end of said element and selectively movable against the borehole, at least in part, independent of movement of said element;

said anti-extrusion device comprises a plurality of ribs that form a smaller dimension for run in and grow to a larger dimension against the borehole;

said ribs are retained to the small dimension by a retainer that is movable along said mandrel;

said retainer is connected to a piston that is held immobile for run in by a locking member that is defeated downhole;

said locking member is defeated by a predetermined exposure to well fluids.

15. The packer of claim 14, wherein:

said piston is acted on by well hydrostatic pressure to move with said retainer away from said ribs upon defeat of said locking member.

16. The packer of claim 15, wherein:

said piston movable by well hydrostatic pressure against a low pressure chamber formed between said mandrel and said piston upon defeat of said locking member.

17. A packer for cased or open hole borehole use, comprising:

a mandrel;

a sealing element selectively movable to seal against the borehole;

an anti-extrusion device mounted adjacent at least one end of said element and selectively movable against the borehole, at least in part, independent of movement of said element;

said anti-extrusion device comprises a plurality of ribs that form a smaller dimension for run in and grow to a larger dimension against the borehole;

said ribs are retained to the small dimension by a retainer that is movable along said mandrel;

said retainer is connected to a piston that is held immobile for run in by a locking member that is defeated downhole;

said locking member is disposed between said piston and said mandrel in a chamber having access to well fluids.

18. A packer for cased or open hole borehole use, comprising:

a mandrel;

a sealing element selectively movable to seal against the borehole;

a cantilevered anti-extrusion device mounted adjacent at least one end of said element and radially overlapping said sealing element, said anti-extrusion device selectively initially movable against the borehole by said sealing element, and thereafter, at least in part, said anti-extrusion device is subsequently movable independent of movement of said element;

said anti-extrusion device comprises a plurality of ribs that form a smaller dimension for run in and grow to a larger dimension against the borehole;

said ribs are made of a shape memory material and upon exposure to well fluids for a predetermined time revert to a position contacting the borehole.

19. A packer for cased or open hole borehole use, comprising:

a mandrel;

a sealing element selectively movable to seal against the borehole;

a cantilevered anti-extrusion device mounted adjacent at least one end of said element and radially overlapping said sealing element, said anti-extrusion device selectively initially movable against the borehole by said sealing element, and thereafter, at least in part, said anti-extrusion device is subsequently movable independent of movement of said element;

said anti-extrusion device comprises a plurality of ribs that form a smaller dimension for run in and grow to a larger dimension against the borehole;

said ribs comprise a bistable material that upon triggering downhole reverts to its alternate position against the borehole.

20. A packer for cased or open hole borehole use, comprising:

a mandrel;

a sealing element selectively movable to seal against the borehole;

an anti-extrusion device mounted adjacent at least one end of said element and selectively movable against the borehole, at least in part, independent of movement of said element;

said anti-extrusion device comprises a plurality of ribs that form a smaller dimension for run in and grow to a larger dimension against the borehole;

said ribs are retained to their small dimension by a retainer that is defeated;

said retainer is made from a metal covered by a polymer wherein the polymer delays exposure of well fluids to the metal and the metal is subsequently compromised by well fluids.

* * * * *